US007033311B2

(12) United States Patent
Krettek

(10) Patent No.: US 7,033,311 B2
(45) Date of Patent: Apr. 25, 2006

(54) CLEANING DEVICE FOR DRUM CENTRIFUGE

(76) Inventor: Guntram Krettek, Mozartstr.4, D-41749 Viersen (DE)

( * ) Notice: Subject to any disclaimer, the term of this patent is extended or adjusted under 35 U.S.C. 154(b) by 0 days.

(21) Appl. No.: 10/491,474

(22) PCT Filed: Oct. 6, 2001

(86) PCT No.: PCT/DE01/03841

§ 371 (c)(1),
(2), (4) Date: Mar. 30, 2004

(87) PCT Pub. No.: WO03/035267

PCT Pub. Date: May 1, 2003

(65) Prior Publication Data

US 2004/0259711 A1 Dec. 23, 2004

(51) Int. Cl.
*B04B 11/08* (2006.01)
*B04B 15/06* (2006.01)

(52) U.S. Cl. ..... 494/29; 494/58

(58) Field of Classification Search ..... 494/27–30, 494/50–51, 55–59; 210/372–376
See application file for complete search history.

(56) References Cited

U.S. PATENT DOCUMENTS 1,542,747 A * 6/1925 Verney ..... 494/58
2,056,890 A * 10/1936 Pecker ..... 210/375
2,056,891 A * 10/1936 Pecker ..... 210/375
2,078,273 A * 4/1937 Pecker ..... 210/375
2,685,968 A * 8/1954 Hertrich ..... 210/375
3,329,275 A * 7/1967 O'Conor ..... 210/375
3,998,381 A * 12/1976 Daub ..... 494/58
4,818,296 A * 4/1989 Hejman et al. ..... 127/2
5,733,238 A 3/1998 Carr
5,743,840 A * 4/1998 Carr ..... 494/13
6,740,027 B1 * 5/2004 Benson ..... 494/29
2004/0023781 A1 * 2/2004 Mukai et al. ..... 494/37
2004/0259711 A1 * 12/2004 Krettek ..... 494/29

FOREIGN PATENT DOCUMENTS

DE 3927707 A1 * 3/1990

(Continued)

*Primary Examiner*—Charles E. Cooley
(74) *Attorney, Agent, or Firm*—Herbert Dubno; Andrew Wilford

(57) ABSTRACT

A centrifuge having a drum rotatable in a predetermined direction about a drum axis has a cleaning device with a cleaning shaft extending generally parallel to the drum axis into the drum along a shaft axis. A pair of elongated slat-shaped cutters have inner ends fixed on the shaft, outer ends, and project radially outward of the shaft axis from the shaft. The inner ends are separated by a relatively narrow space, and the cutters diverge from their inner ends toward their outer ends. The shaft can be moved such that the cutters are displaced between a standby position offset from the drum and a cleaning position closely juxtaposed therewith. A cleaning liquid is fed to each cutter such that it flows along the cutters.

14 Claims, 3 Drawing Sheets

FOREIGN PATENT DOCUMENTS

| | | | | |
|---|---|---|---|---|
| DE | 19509287 | A1 | * | 10/1996 |
| DE | 19914086 | A1 | * | 9/2000 |
| DE | 19914089 | A1 | * | 9/2000 |
| DE | 19925082 | A1 | * | 12/2000 |
| EP | 0345178 | A1 | * | 12/1989 |
| EP | 1228807 | A1 | * | 8/2005 |
| FR | 1215054 | | * | 4/1960 |
| JP | 64-90051 | | * | 4/1989 |
| JP | 2-26656 | | * | 1/1990 |
| JP | 7-862 | | * | 1/1995 |
| JP | 7-289946 | | * | 11/1995 |

* cited by examiner

CLEANING DEVICE FOR DRUM CENTRIFUGE

CROSS REFERENCE TO RELATED APPLICATIONS

This application is the US national phase of PCT application PCT/DE01/03841, filed 6 Oct. 2001, published 1 May 2003 as WO 03/035267.

FIELD OF THE INVENTION

The present invention is directed to a wet classification device in the form of a centrifuge provided with a stationary outer housing, a centrifugal drum arranged in the outer housing, a cleaning device for the sediment deposited on the wall of the centrifugal drum, and inlets and outlets.

BACKGROUND OF THE INVENTION

Such a wet classification device is known. It is used for the separation of the coarse portion of powders, as titanium dioxide, for example. So, today more and more ultrafine materials having a particle size between 0.1–5 pm are used. Such particles sizes can be obtained by fine grinding of crude substances which, however, implies relatively high operating costs since the energy consumption is very high, cooling systems are required, a relatively high environmental contamination is caused and a large portion of undersized particles is generated, etc. Such problems do not exist with wet classification centrifuges. Here, the solid (powder) is mixed with a liquid (normally water) in a pre-mixing tank in order to obtain a suspension. If necessary, the suspension is diluted in a following dilution tank and then introduced into the wet classification device which is formed as a centrifuge. Within the rotating centrifugal drum the heavier and coarser particles are fed radially outwardly against the drum wall in a faster manner than the lighter and finer particles of the suspension so that they are deposited as sediment. The sediment is removed from the drum wall in cleaning phases of the wet classification device wherein for this, depending on the respective embodiment, cleaning liquids, mechanical cleaning means, knives etc., are used. Finally, the sediment which is redispersed in the cleaning liquid is discharged from the centrifugal drum and is fed to a separately arranged ball mill, for instance, in which the coarse portion of the redispersed suspension is ground. Then, the process suspension can be introduced into the system again, for instance fed to the pre-mixing tank.

During the classification process the classified suspension is continuously withdrawn from the wet classification device and is made available for further usage.

When centrifuging ultrafine materials in a plurality of application cases high centrifuging factors are required for a high separation effect in addition to an optimum rotor design. On account of these high centrifuging factors a very stable and very hard sediment cake is generated with a corresponding centrifuging time. Furthermore, in a plurality of applications hard substances having a Mohs hardness between 3 to 10 have to be centrifuged while suspended in liquid. Normally, the devices known for scrubbing centrifuges fail in this connection, i.e. they cannot peel out or strip the sediment cake. This was confirmed in the past by worn knives, broken peeling devices as well as bent or broken knife shafts. Accordingly, on account of the high cutting forces also a braking of the main drive motor to standstill occurs.

OBJECT OF THE INVENTION

It is the object of the invention to provide a wet classification device of the above-cited kind where the sediment cake can be peeled out or stripped away in an especially problem-free manner.

SUMMARY OF THE INVENTION

According to the invention this object is obtained with a wet classification device of the cited kind by the following features:

The cleaning device includes a shaft pivotable or linearly movable in the centrifugal drum and having arranged at its periphery at least two slat-like cutters, and a device for introducing a dispersing liquid into the centrifugal chamber, and the two cutters are inclined toward one another, together form a space expanding in the direction of movement of the shaft, and are separated at a gap between them at their adjacent inner ends.

The above-cited problems are avoided with the inventive solution. Herewith it is possible to peel out or strip off the sediment cake without any problems and without damaging the cutters and the shafts carrying them. In other words, wear at the cutters and the shafts carrying them is reduced, and smaller forces than with the prior art are generated so that fractures, deflections, etc. of the cutters and of the shafts are largely avoided. Even the problems generated with the prior art by the high cutting forces with regard to a negative influence (braking) of the main drive motor are avoided.

As mentioned above, this is obtained by a special design of the cleaning device of the wet classification device. With the cleaning device a combination of mechanical features together with the supply of a dispersing liquid is used. By the design of the mechanical features, i.e. the special arrangement and design of the cutters, a swirling of the supplied dispersing liquid is obtained which has a positive effect on the peeling and discharging of the sediment cake.

Especially, the cutters inclined toward one another and forming a space narrowing opposite to the moving direction of the shaft, which space terminates in a gap, have the effect that no linear flow conditions of the dispersing liquid are caused but turbulences are generated by the pushing back of the liquid toward the sediment occuring again and again, which turbulences cause an intensive swirling of the dispersing liquid resulting in an intensive wash-out effect on the surface of the sediment. By this, the cake can be removed in an easier and better manner by the cutters entering into the cake, i.e. lower forces for the removal are necessary than with the prior art. The above-cited hydrodynamic effects are obtained by the narrowing of two adjacent cutters which results in the above-mentioned gap which has to be present in order to enable minimal flowing-past of the dispersing liquid.

Preferably, the dispersing liquid is added during the cutting-in and back-flush phases of the cleaning device. The liquid in the centrifugal drum left over from the classification process is normally not sufficient to obtain the above-mentioned hydrodynamic effect (swirling in the region of the surface of the sediment cake).

It is guaranteed by the narrowing or expanding space that the additional dispersing liquid (diluting liquid) supplied during the cleaning process is fed to the region of largest diameter of the drum and thus also to the thickest sediment mass. In this manner the already mentioned intensive swirling results effects a certain wash-out effect of the cake also.

Accordingly, no concrete mechanical contact between the sediment cake and the tips of the cutters takes place. The sediment cake is instead liquified and flushed away in such a manner that the material is protected.

As regards the infeed of the dispersing liquid into the centrifugal drum, preferably the means for the introduction of the dispersing liquid opens in the head portion of the cutters in the centrifugal chamber. In this manner the dispersing liquid is directly fed into the proximity of the surface of the sediment cake so that the desired swirling effect can be obtained very well. According to this solution the supplied dispersing liquid does not have to be introduced first into the liquid column (classification liquid) present in the centrifugal drum but the introduction of the dispersing liquid is carried out directly within the liquid column which results in a number of advantages.

Investigations have shown that the slat-like cutters should be preferably arranged with an angle of 15–45° with respect to a plane perpendicularly intersecting the shaft axis in order to obtain the best results with regard to a peeling without problems.

Appropriately, the gap between the adjacent ends of the cutters is adjustable in response to the solids content and the viscosity of the suspension or further parameters. In this manner optimum conditions can be achieved for the respective application. Of course, the size of the expanding or narrowing space (the spacing between the inclined cutters) is also adjusted by the above-mentioned gap adjustment. Also the cutters can be adjusted in such a manner that their angle of inclination is varied.

According to an especially preferred embodiment of the invention the gap also expands in the direction from the shaft toward the head of the cutters. Accordingly, a preferably double conical design results in this manner which also favors the above-cited effects. In this manner double turbulences are generated which further promote the removal. Accordingly, with this embodiment the space between the two cutters is additionally narrowed toward the smallest radius.

According to another embodiment of the invention the cutters or their heads have structured surfaces. These surfaces can be formed with grooves, ridges etc., for example. All the surfaces of the cutters or only a part of these surfaces can be structured. In this manner an additional swirl generation in the supplied dispersing liquid is achieved.

The cutters can be removably mounted on the shaft and can be thus replaced depending on the application.

Preferably, the means for the introduction of the dispersing liquid has a passage extending through the shaft and from which passages extending through the cutters are branched off. Accordingly, the dispersing liquid can be fed out to the tips of the cutters and can flow out into the centrifugal chamber at a position adjacent to the sediment case.

The shaft can carry out a linear movement or a pivotal movement in order to move into the sediment cake. When a pivotal movement is carried out the shaft preferably moves about 80–120° in order to enter into the sediment. Accordingly, in this case the shaft moves in steps (forward and backward) through the desired angular range. This movement can be preferably adjusted in response to the respective product.

Practically, the means for the introduction of the dispersing liquid introduces it during the cutting-in and back movement phases of the shaft.

As regards the design of the slat-like cutters, the invention does not have any restrictions. Known slat-like cutters (knives) can be used. Preferably, the slat-like cutters consist of flat steel profiled bars covered with high-strength material.

With the embodiment according to which the dispersing liquid is fed through passages extending through the cutters. These passages preferably open at the front sides of the cutters so that the dispersing liquid flows out into the drum chamber from the front sides of the cutters.

The introduced dispersing liquid can be pressurized in order to further support the above-cited wash-out effect. In addition to a pure dispersing function it can also have further functions, for instance washing functions, adjustment functions for the concentration of solids, etc.

The invention has especially good results if the centrifugal drum has chambers separated by separation walls. Preferably, the separation walls extend horizontally and form rings which are connected with the outer wall of the drum. The arrangement of such separation walls is known on principle.

The present invention is especially used with wet classification devices having a slimness ratio of the centrifugal drum of L/D>1.2, where L is the length or height of the classification surface available in the centrifugal drum and D is the inside diameter of the centrifugal drum. Such a wet classification device is described in DE 199 25 082 A1. The disclosure of this publication is introduced into the present disclosure by reference.

Furthermore, the invention is suited especially well with a wet classification device which, is provided with an integrated grinding device. For instance, such a wet classification device is described in DE 199 14 089 A1. The disclosure of this publication is herewith incorporated into the present disclosure by reference.

Finally, the invention is especially well suited for a wet classification device which is simultaneously formed as dispersing device. For instance, such a device is described in DE 199 14 086 A1. The disclosure of this publication is also herewith incorporated into the present disclosure by reference either.

BRIEF DESCRIPTION OF THE DRAWING

The instant invention is described below in detail by means of an example in connection with the drawing. In the drawing.

SPECIFIC DESCRIPTION

Figure 1:
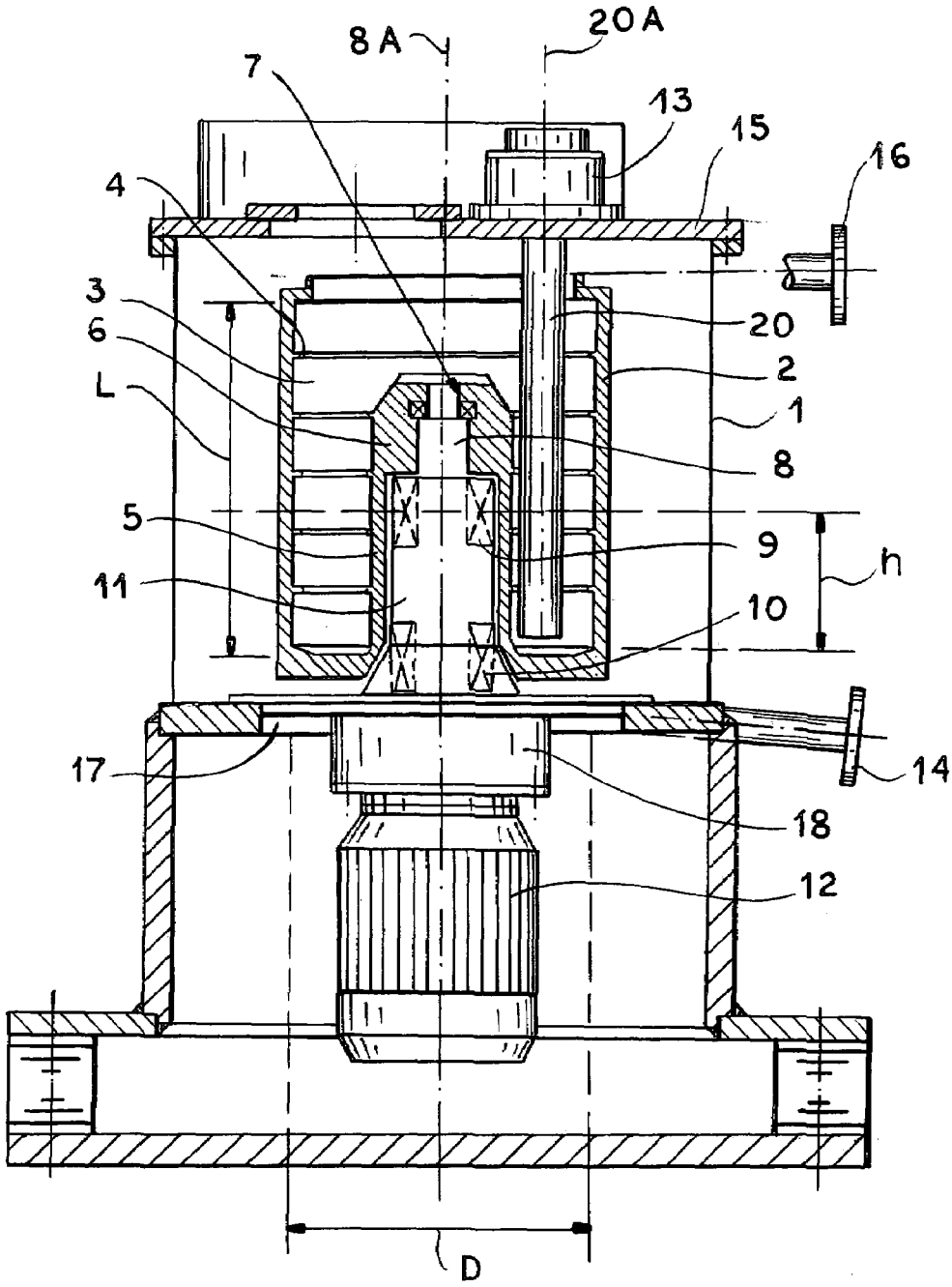
FIG. 1 shows a longitudinal section through a wet classification device wherein the cutters provided at the shaft are not.

The wet classification device in the form of a centrifuge shown in FIG. 1 has a stationary housing 1 with a cover 15. The stationary housing 1 is supported on a base by suitable vibration damping means. A centrifugal drum 2 with a vertical axis 2A is arranged within the stationary housing 1 and is rotated by a vertical shaft 8 about its center axis 2A. The vertical shaft 8 extends into the centrifugal drum 2 from below. It is surrounded by a support housing 11 containing an upper main bearing 9 and a lower second bearing 10 for the support of the shaft 8. The support housing 11 is fastened to a plate 17 which again is fastened to the stationary housing 1. The shaft 8 extends through the support housing 11 and the plate 17 down to a suitable clutch 18 and therethrough to an electric motor 12 forming a direct drive. The speed of the shaft 8 is variable.

The centrifugal drum 2 has an inlet (not shown) for the suspension which has to be classified which extends, for instance as a tube, down into the centrifugal drum 2 from above into the lower end portion of the drum 2 where it has an outflow opening. The classified suspension is withdrawn from the upper end of the centrifugal drum 2 through a discharge tube 16. Another discharge tube 14 at the lower end of the centrifugal drum 2 serves for withdrawing sediment during a cleaning operation.

As one can further see in FIG. 1, the centrifugal drum 2 is thus formed like a circular ring in its lower portion and is similarly circular in its upper portion. Horizontal separation walls 4 divide the interior of the centrifugal drum into six classifying chambers 3 disposed one above the other and having relative to the axis 2A radially inwardly directed faces on which sediment is deposited. The deposited sediment is removed by a cleaning device which is schematically shown at 13.

The centrifugal drum 2 described here is formed as slim as possible, and the main bearing 9 of the shaft is arranged as centrally as possible, i.e. near the center of gravity of the centrifugal drum 2. Thus the main bearing 9 is set so deep in the centrifugal drum 2 that the vertical center of the main bearing 9 of the shaft 8 is at a height h measured from the inner lower end of the centrifugal drum 2 that corresponds to approximately 40% of the length or height L of the classifying surface available in the centrifugal drum 2. Furthermore, the slimness ratio L/D of the centrifugal drum, i.e. the ratio between the length or height L of the classifying surface available in the centrifugal drum and an inner diameter D of the centrifugal drum 2, has a value of approximately 1.24. Of course, the above-cited ratio is only exemplary. According to this embodiment six classifying chambers 3 are disposed one above the other in the centrifugal drum 2.

As mentioned above, an upper main bearing 9 and a lower second bearing 10 for the shaft 8 are disposed within the support housing 11. In this manner a stable support results. The shaft 8 extends above out of the support housing 11 and terminates in a portion with reduced diameter. The central hub 6 of the centrifugal drum which is formed in the axial extension of the cylindrical inner wall 5 of the centrifugal drum is fixed at this portion. The fixation is realized through frictional contact at 7. At the upper end the hub 6 is closed by a cover.

The operation of such a wet classification device is known and does not need to be described in more detail here. It is essential that a large distance between inlet and outlet and thus a reduction of the danger of short circuit flows results from the selected high slimness ratio so that ultimately a better separation results. Furthermore, a high centrifugal factor (it can be operated with high speeds) and a large classifying surface are achieved by a plurality of chambers disposed one above the other.

Of course, on account of these circumstances especially high standards with respect to the operability of the cleaning device 13 have to be set since a correspondingly stable and very hard sediment cake is generated. These standards are fulfilled with the cleaning device described in the following.

The cleaning device 13 has a shaft 20 projecting into the centrifugal drum from above along an axis 20A parallel to the axis 8A and carrying out a step movement (pivotal movement about an angle of approximately 80–120°) into the sediment cake formed at the drum wall and back into its original position. A dispersing liquid is introduced into the centrifugal drum 2 not only during the cutting-in phase but also during the back movement phase of the shaft 20. Details are described below.

Figure 2A:
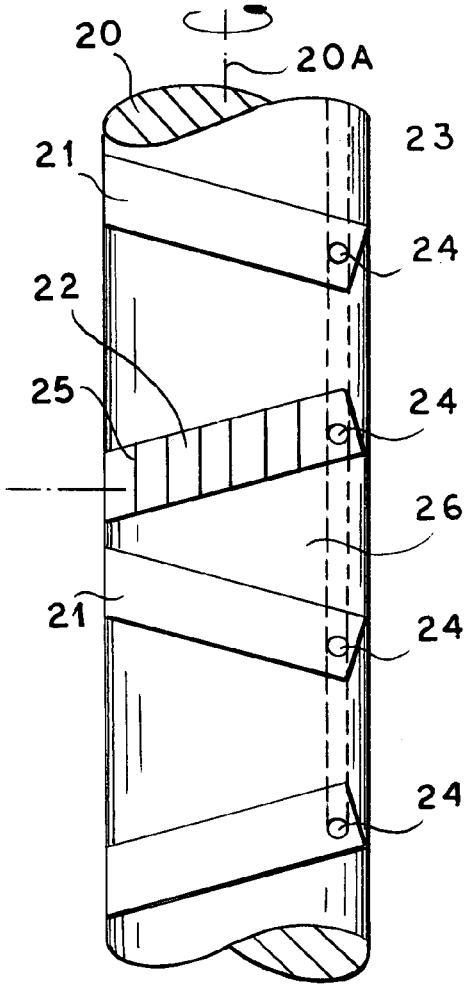
FIGS. 2A, 2B, and 2C shows an enlarged detail view of the shaft with cutters, of a portion of the side wall of the drum, and of one of the cutters.
Figure 2B:
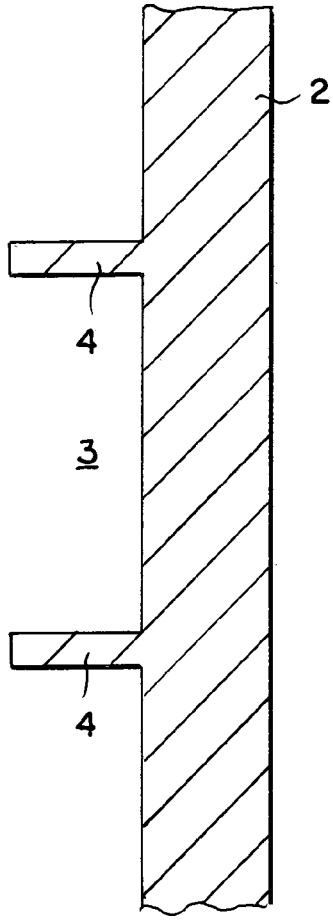
Figure 2C:
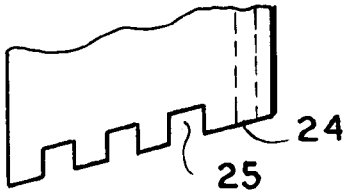

FIGS. 2A, 2B, and 2C an enlarged representation of a part of the shaft 20 of the cleaning device 13 and associated structure. This shaft 20 is driven by means of a suitable step motor. A plurality of slat-like cutters 21, 22 are disposed at the periphery of the shaft 20 one above the other, two adjacent cutters 21, 22 being inclined toward one another and together forming a space 26 expanding in the direction of movement of the shaft 20 and having a gap X between them at their adjacent inner ends. The slat-like cutters 21, 22 (knives) are structured over their complete surfaces, i.e. provided with grooves, as schematically shown at 25 at a cutting device 22 in FIG. 2C.

Figure 3:
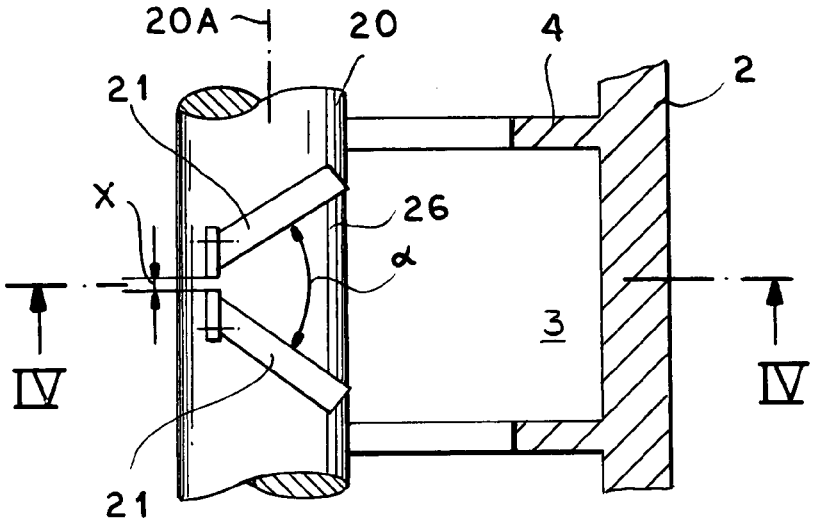
FIG. 3 shows a section from FIG. 2 with cutters shown in detail.
Figure 4:
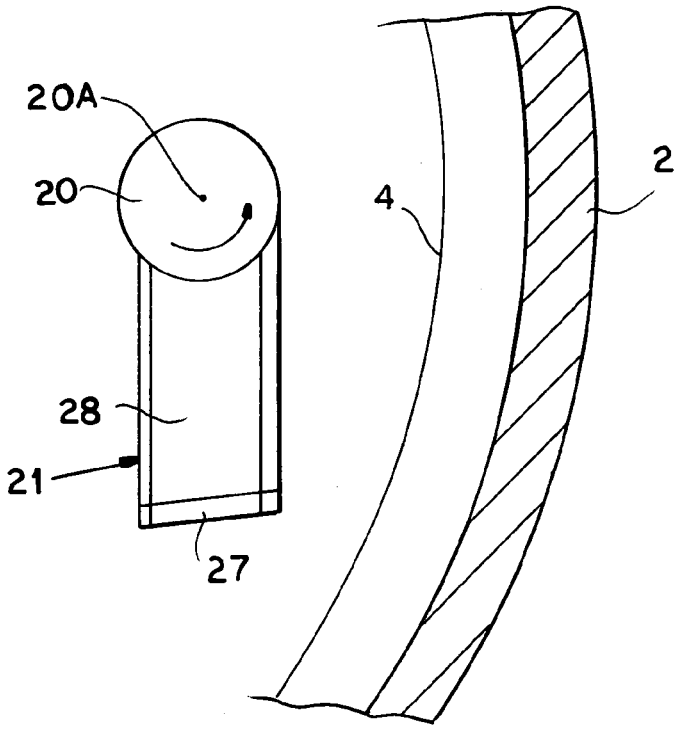
FIG. 4 shows a sectional view along line IV—IV of FIG. 3.

FIGS. 3 and 4 show the exact design of the cutters 21, 22. One recognizes that the cutters 21, 22 are inclined in such a manner that they each form an angle (a/2) of 15–45° to a plane perpendicular to the shaft axis 20A. In this embodiment the main plane of the cutters 21, 22 extends perpendicularly to the axis 20A of the shaft 20, it can however also extend obliquely with respect to this axis 20A so that the gap X and the space 26 expand in radial direction toward a larger diameter. The horizontal sectional view of FIG. 4 shows the lower cutting device 21 of FIG. 3 with its outer end 27 and body 28. The cutting device consists of a flat profiled steel bar which is armoured.

FIG. 2A shows that a supply passage 23 for the dispersing liquid (cleaning liquid) is formed within the shaft 20 and extends parallel to the shaft axis 20A. Two passages 24 extend from passage 23 through the respective slat-like cutters 21, 22 and open at the front surfaces (heads) of the cutters.

The gap X formed between the adjacent cutters and thus the expanding space 26 formed by them is adjustable.

The cleaning device 13 operates in such a manner that the step motor (not shown) moves the shaft 20 counterclockwise through about 80–120° from an inner standby position into an outer cleaning position engaged in the sediment cake formed within the chambers 3. During this phase of movement dispersing liquid is supplied through the passages 23 and 24 and discharged into the drum chamber at the tips (heads) of the cutters 21 and 22. The outflowing dispersing liquid is again and again pushed toward the sediment cake by the inclined arrangement of the cutters and is swirled. In this manner a corresponding wash-out process on the surface of the sediment cake is achieved so that it is not necessary that the cutters 21, 22 directly contact the sediment cake. The sediment cake is instead liquified and thus peeled by the cutters 21, 22 in a material-conserving manner. During the backward movement of the shaft 20 dispersing liquid is also fed in so that a good and complete removal of the sediment cake can be achieved.

The invention claimed is:

1. In a classifying centrifuge having a drum rotatable in a predetermined direction about a drum axis, a cleaning device comprising:

a cleaning shaft extending generally parallel to the drum axis into the drum along a shaft axis;

a pair of elongated slat-shaped cutters having inner ends fixed on the shaft, outer ends, and projecting radially outward of the shaft axis from the shaft, the inner ends being separated by a relatively narrow space, the cutters diverging from their inner ends toward their outer ends;

means for moving the shaft such that the cutters are displaced between a standby position offset from the drum and a cleaning position closely juxtaposed therewith; and means for feeding a cleaning liquid to each cutter such that the liquid flows along the cutters.

2. The cleaning device defined in claim 1 wherein the means feeds the cleaning liquid to the outer ends of the cutters.

3. The cleaning device defined in claim 1 wherein the cutters each extend at an angle between 15° and 45° to a plane perpendicular to the shaft axis.

4. The cleaning device defined in claim 1 wherein the cutters are adjustable relative to each other.

5. The cleaning device defined in claim 1 wherein the cutters have structured surfaces.

6. The cleaning device defined in claim 1 wherein the cutters are removably mounted on the shaft.

7. The cleaning device defined in claim 1 wherein the means for feeding the liquid includes a main passage extending generally longitudinally through the shaft and branch passages extending from the main passage through the respective cutters.

8. The cleaning device defined in claim 1 wherein the means for moving the shaft oscillates it through between 80° and 120° about the shaft axis.

9. The cleaning device defined in claim 1 wherein the means for feeding only operates when the shaft is out of the standby position.

10. The cleaning device defined in claim 1 wherein each cutter is formed as a flat steel bar.

11. The cleaning device defined in claim 1 wherein the cutters have front faces and the means for feeding the liquid opens at the front faces.

12. The cleaning device defined in claim 1 wherein the means for feeding the liquid expels the liquid under pressure into the drum.

13. The cleaning device defined in claim 1 wherein the drum is separated by partitions into a plurality of chambers, the shaft being provided with one such pair of cutters in each of the chambers.

14. The cleaning device defined in claim 1 wherein the drum has an effective internal height L and an inside diameter and a ratio L/D is equal to about 1.2.

* * * * *